United States Patent [19]

Baatz et al.

[11] Patent Number: 4,894,550

[45] Date of Patent: Jan. 16, 1990

[54] SHIELDED RADIOACTIVE-WASTE CONTAINER

[75] Inventors: Henning Baatz; Dieter Rittscher, both of Essen, Fed. Rep. of Germany

[73] Assignee: GNS Gesellschaft fur Nuklearservice MBH, Essen, Fed. Rep. of Germany

[21] Appl. No.: 505,227

[22] Filed: Jun. 17, 1983

[51] Int. Cl.[4] ..... G21F 5/00

[52] U.S. Cl. ..... 250/506.1

[58] Field of Search ..... 250/506.1; 159/DIG. 12; 202/197; 203/40; 58/185

[56] References Cited

U.S. PATENT DOCUMENTS

| | | | |
|---|---|---|---|
| 2,224,984 | 12/1940 | Potts et al. | 203/40 |
| 3,361,649 | 1/1968 | Karter | 159/DIG. 12 |
| 3,404,722 | 10/1968 | Bloone | 159/DIG. 12 |
| 4,246,233 | 1/1981 | Sheeline | 159/DIG. 12 |

FOREIGN PATENT DOCUMENTS

| | | | |
|---|---|---|---|
| 546414 | 7/1942 | United Kingdom | 203/40 |

OTHER PUBLICATIONS

WO8100218 2/81.

*Primary Examiner*—Sam Silverberg

*Attorney, Agent, or Firm*—Herbert Dubno

[57] ABSTRACT

A shielded container for the treatment of radioactive waste has an upwardly open cast-iron vessel having a closed bottom, solid walls unitary therewith, and an open upper mouth itself closed by a cast-ion lid which is formed with separate vertically throughgoing intake and outlet passages. Screwthread formations either provided directly on the lid and vessel or on fasteners engaged between them hermetically secure the lid over the mouth. A flow deflector aligned inside the vessel underneath the outlet passage can be formed as a plate so aspirated gases do not entrain liquid or solid particles. A single cover is held by appropriate screwthread formations on the cover over the passages. The vessel can be relatively thin—8cm, 12cm, or 18cm—cast iron so it is possible to treat its contents. For drying radioactive wastes it is merely necessary to heat the outside of the container while applying suction to the outlet passage.

4 Claims, 2 Drawing Sheets

SHIELDED RADIOACTIVE-WASTE CONTAINER

FIELD OF THE INVENTION

The present invention relates to a shielded radioactive-waste container. More particularly this invention concerns a so-called lost-concrete shield container of the type used for holding liquid radioactive wastes of a nuclear-power plant.

BACKGROUND OF THE INVENTION

Such a shielded lost-concrete container comprises a vessel having unitary walls and floor. A lid blocks the upwardly open mouth of the vessel and is normally also formed of concrete by pouring in concrete once the container is filled with radioactive wastes. Such a shield container cannot also be used as a treatment vessel for the drying of its contents by heating it with its contents under vacuum.

It is also known to transport and store spent fuel elements in cast-iron or -steel containers with a wall thickness of at least 40 cm. Externally these containers have heat-exchange ribs and the cover or lid of such a container is also usually a casting of the sam metal as the vessel it is closing. Such containers can also be used to treat the wastes, typically by heating them while exhausting vapors generated in them by the heat. In this manner the wet but mainly solid phase of matter filtered out of the cooling circuit of a nuclear-power plant can be dried out for permanent storage disposal.

OBJECTS OF THE INVENTION

It is therefore an object of the present invention to provide an improved shield container for radioactive waste.

Another object is the provision of such a shield container for radioactive waste which overcomes the above-given disadvantages, that is which can be used both for the treatment, storage, and transport of the wastes.

SUMMARY OF THE INVENTION

A shielded container for the treatment of radioactive waste according to the invention has an upwardly open cast-iron vessel having a closed bottom, solid walls unitary therewith, and an open upper mouth itself closed by a cast-iron lid which is formed with separate vertically throughgoing intake and outlet passages. Screwthread formations either provided directly on the lid and vessel or on fasteners engaged between them hermetically secure the lid over the mouth. A flow deflector aligned inside the vessel underneath the outlet passage can be formed as a plate so aspirated gases do not entrain liquid or solid particles. A single cover is held by appropriate screwthread formations on the cover over the passages.

Thus the vessel according to this invention can be relatively thin—8 cm, 12 cm, or 18 cm—cast iron so it is possible to treat its contents. For drying radioactive wastes it is merely necessary to heat the outside of the container while applying suction to the outlet passage. The subatmospheric pressure thus created in the vessel allows the water to vaporize at well below 100° C., thereby drying the material with minimal energy and likelihood of vaporizing other potentially radioactive constituents of the waste being treated.

According to this invention the flow deflector is a horizontal plate underlying and spaced below the outlet passage. In addition for most effective heating of the container the vessel has a smooth outer surface shaped to interfit with a heater jacket.

The system may also be provided with a tube connected to and extending downward in the vessel from the intake passage and forming a downward extension thereof. This is particularly useful when an ion-exchange resin is to be introduced into the container in the form of lumps or particles.

For maximum shielding the cast-iron vessel is provide with a lead lining. This makes the vessel capable of shielding as much radioactivity as much heavier all iron or concrete ones. In addition the overall container weight is not excessive.

DESCRIPTION OF THE DRAWING

The above and other features and advantages will become more readily apparent from the following, reference being made to the accompanying drawing in which.

SPECIFIC DESCRIPTION

Figure 1:
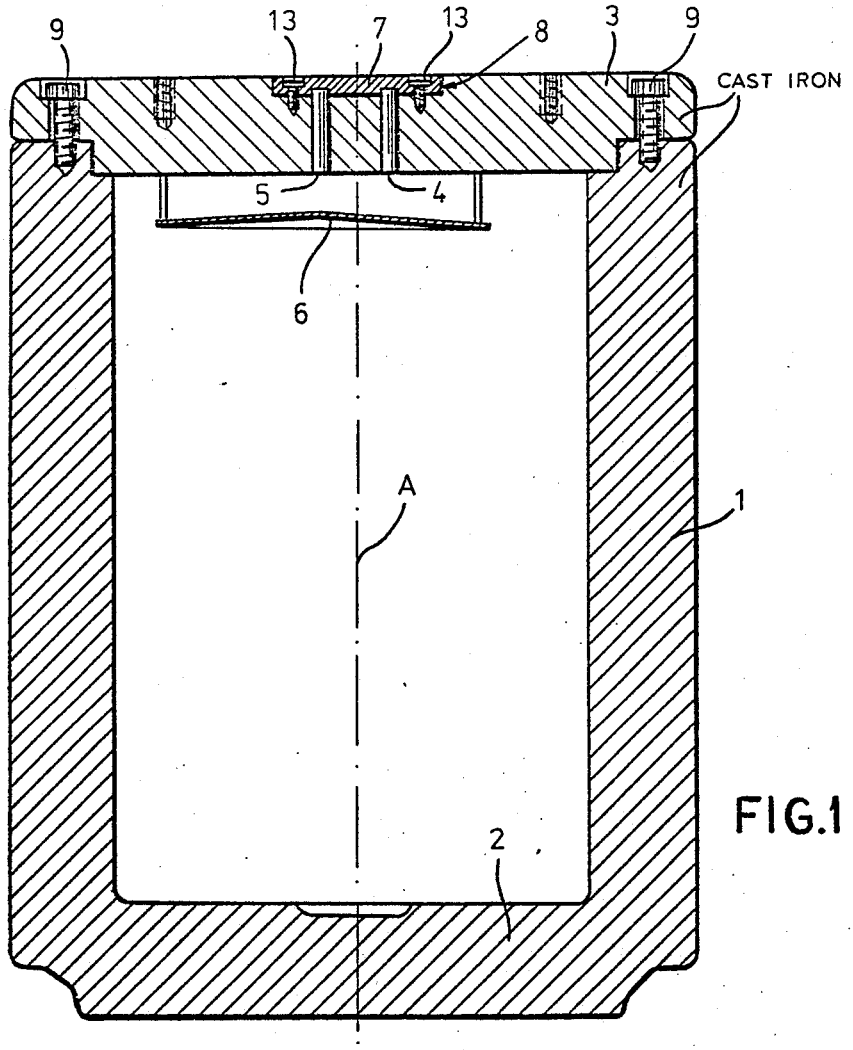
FIG. 1 is an axial section through a container according to the invention.
Figure 2:
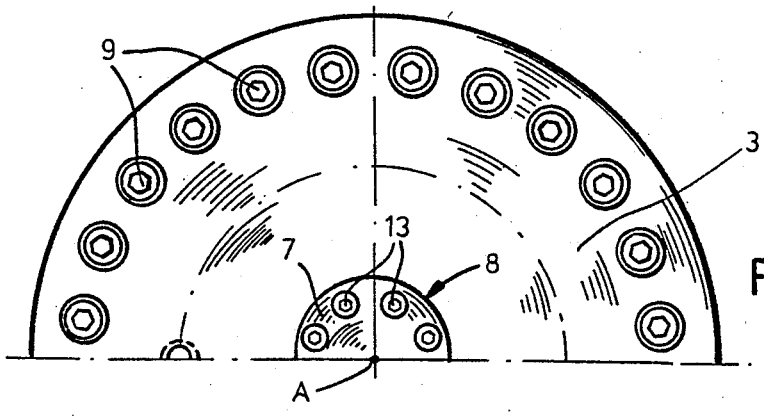
FIG. 2 is a top view of a portion of the container of FIG. 1.
Figure 3:
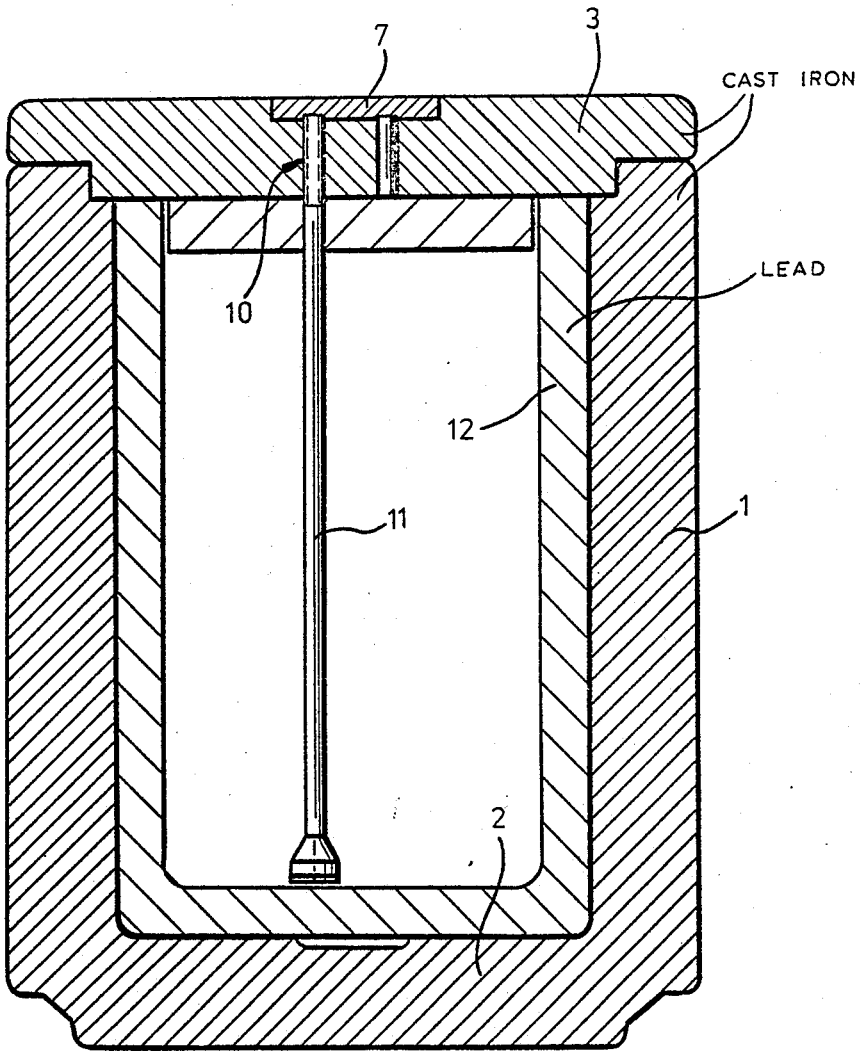
FIG. 3 is a view like FIG. 1 of another container according to the invention.

As seen in FIGS. 1 and 2 a cast-iron treatment vessel 1 is centered on an axis A and has a wall thickness of 8 cm, 12 cm, or 18 cm and has a unitary closed bottom or floor 2. The upper edge or rim is stepped and fitted to a lid 3 also formed of cast iron. The cylindrical outer surface of the vessel 1 is not provided with cooling ribs, but is smooth so it can fit within an electric coil-type heater. In addition as shown in FIG. 3 the vessel 1 can have a lead lining 12.

The lid 3 is formed with a pair of throughgoing passages 4 and 5, both parallel to and offset from the axis A. The passage 4 serves for the introduction of a fluid into the vessel 1, and the passage 5 for the withdrawal of fluids from it. Although this lid 3 could be formed with its own screwthread so it could be screwed directly down into the rim of the vessel 1, here it is secured in place by a group of machine screws 9 angularly equispaced about and threaded into the vessel 1.

In a typical application the condenser concentrate of a nuclear-power plant can be held in this vessel 1 while it is heated and gas is withdrawn through the passage 5, creating subatmospheric pressure therein. This will draw off low-temperature and relatively clean steam, while leaving the radioactive particulates inside the vessel 1.

In order to prevent droplets or particles from being aspirated, a downwardly flaring and generally conical plate 6 interrupts vertical and axial flow into the passage 5. Thus any rising gases will have to change direction and move horizontally to get past the plate 6 to the passage 4, and then change direction again to enter this passage 5. Gas rising immediately underneath the plate 6 will be forced through two more direction changes. In any case it is apparent that such an arrangement will effectively strip liquid and solid particles from the gas stream aspirated at the passage 5. The upwardly tapering surface of the plate 6 allows drops to run smoothly down and drip harmlessly from its rim.

The upper surface of the lid 3 is formed at the upper ends of the passages 4 and 5 with a shallow cylindrical recess 8 into which is fitted a cylindrical cover 7 that is in turn fixed in place by screws 13 like the screws 9, although once again this element 7 could itself be externally threaded to fit into the recess 8 which would be internally threaded. Thus this cover 7, whose upper surface is flush with that of the lid 3, seals off both of these passages 4 and 5, making the container easy and safe to handle.

It is also possible as seen in FIG. 3 to provide the lid 3 with a passage 10, which may serve either for intake or outlet, with a tube or lance 11 in the manner suggested in our jointly filed application Ser. No. 505,228 filed of June 1983. This allows the container to be filled from the bottom up, or allows gas or liquid to be aspirated from the very bottom of the container.

The cast-iron assembly according to this invention is of sufficiently thin wall thickness that it can be fitted snugly into a heating jacket, for instance one traversed by water or having an electric coil, and heated without great losses.

We claim:

1. A shielded container for the treatment of radioactive waste, the container comprising:

an upwardly open cast-iron vessel having a closed bottom, solid walls unitary therewith, and an open upper mouth, said vessel having a smooth outer surface shaped to interfit with a heater;

a cast-iron lid sealingly engaged over and completely blocking the mouth, the lid being formed with separate vertically throughgoing intake and outlet passages;

means including screwthread formations for hermetically securing the lid over the mouth;

a flow deflector aligned inside the vessel and spaced directly underneath the outlet passage, said deflector being a horizontal plate;

a single unitary cover sealingly engageable on the lid over both the passages; and means including screwthread formations for hermetically engaging the cover over the passages.

2. The radioactive-waste treatment container defined in claim 1, further comprising a tube connected to and extending downward in the vessel from the intake passage and forming a downward extension thereof.

3. The radioactive-waste treatment container defined in claim 1 wherein the vessel has a wall thickness less than about 20 cm.

4. The radioactive-waste treatment container defined in claim 3 wherein the vessel is provided with a lead lining.

* * * * *